United States Patent [19]

Nordendale

[11] 4,176,533

[45] Dec. 4, 1979

[54] WALL SAFE LOCK

[76] Inventor: Paul A. Nordendale, 3740 Dauphine Ave., Northbrook, Ill. 60062

[21] Appl. No.: 842,094

[22] Filed: Oct. 14, 1977

Related U.S. Application Data

[63] Continuation-in-part of Ser. No. 639,250, Dec. 10, 1975, abandoned.

[51] Int. Cl.[2] ..... E05B 63/14; E05B 37/16

[52] U.S. Cl. ..... 70/115; 70/288; 70/298

[58] Field of Search ..... 70/82, 83, 88, 113–115, 70/119, 122, 214, 220, 286–288, 291–300, 315, 320

[56] References Cited

U.S. PATENT DOCUMENTS

| | | | |
|---|---|---|---|
| 656,157 | 8/1900 | Alm | 70/298 |
| 706,152 | 8/1902 | Beebe | 70/298 |
| 1,092,733 | 4/1914 | McCarthy | 70/298 |
| 1,430,332 | 9/1922 | Smith | 70/298 X |
| 1,499,963 | 7/1924 | Beckman | 70/298 |
| 1,567,811 | 12/1925 | Murphy | 70/114 |

FOREIGN PATENT DOCUMENTS

| | | | |
|---|---|---|---|
| 493535 | 4/1954 | Italy | 70/288 |
| 551652 | 11/1956 | Italy | 70/286 |
| 1269512 | 4/1972 | United Kingdom | 70/298 |

*Primary Examiner*—Roy D. Frazier
*Assistant Examiner*—William E. Lyddane
*Attorney, Agent, or Firm*—Watson D. Harbaugh

[57] ABSTRACT

A multiple pushbutton permutation lock in which push pins equally retarded frictionally in their movement must be manually moved and held actuated in the right combination and pattern to permit a spring-urged slide bar to slide out of a rotationally located critically limiting slot on a hidden disk before manual actuation of the latch can be accomplished for opening the door of the safe.

7 Claims, 7 Drawing Figures

FIG 4
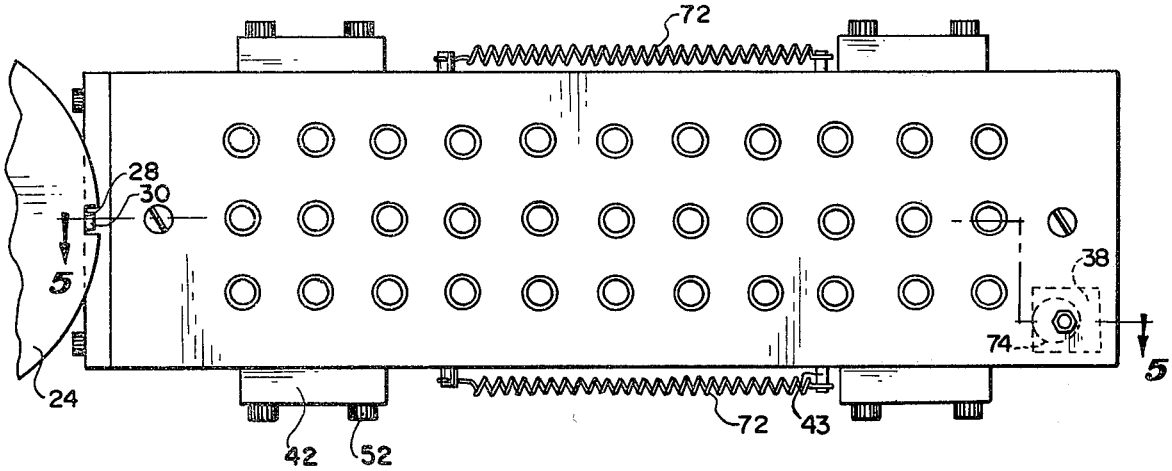
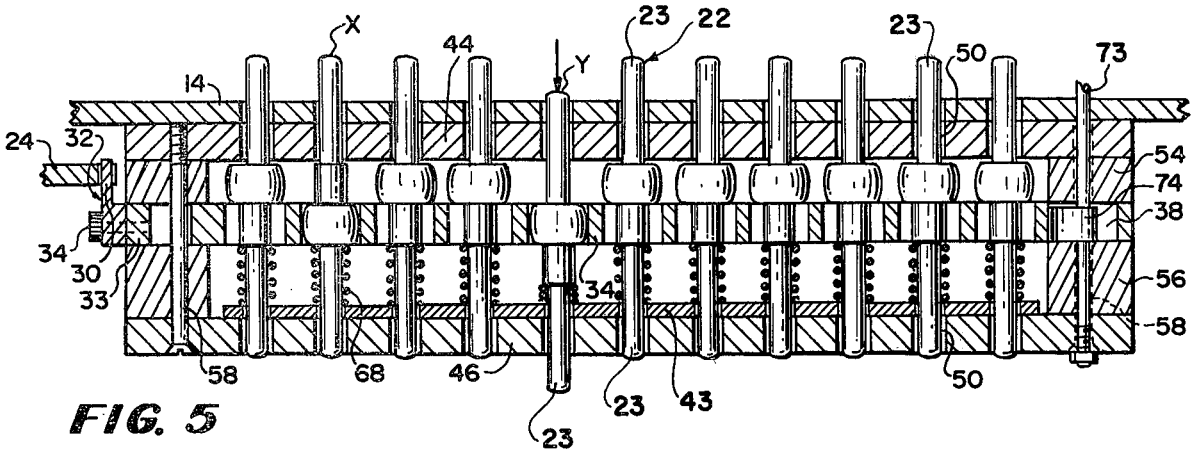
FIG. 5
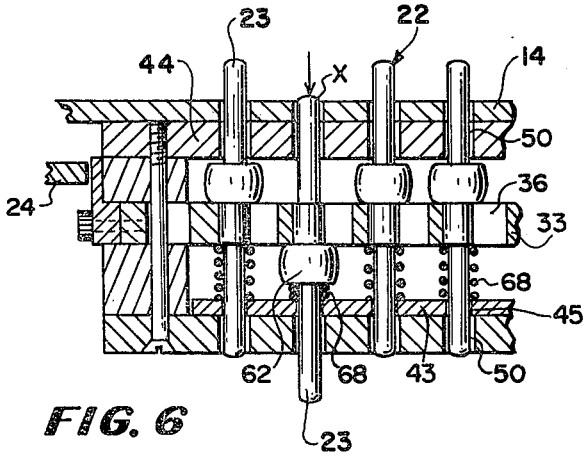
FIG. 6
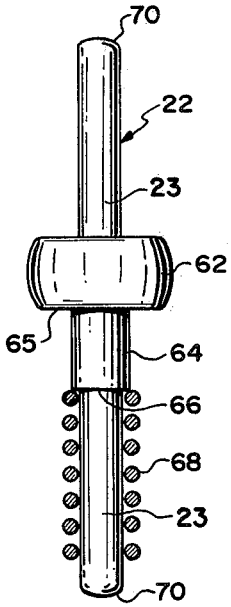
FIG. 7

WALL SAFE LOCK

This application is a continuation-in-part of application Ser. No. 639,250, filed Dec. 10, 1975, now abandoned.

BACKGROUND OF THE INVENTION

Combination pushbutton permutation locks, as such are comparatively old in the art as illustrated in the complex arrangement of Beebe U.S. Pat. No. 706,152 (1902), even to the changing of the combination by reversing push pins that extend through apertures in a lock plate. Both elements are complicated and difficult to make and use since tumblers mounted in slots of rigid plates coact with a lock plate and are actuated by finger keys to control a slide with a bolt mechanism actuated by the slide. (See also variations of pushbutton permutation locks shown in Morford U.S. Pat. No. 494,154 (1893); Broshkewitz U.S. Pat. No. 903,170 (1908) or McCarthy U.S. Pat. No. 1,092,733 (1914). However, the feel of the operation of the finger keys and parts in the earlier devices provides the trial and error experimentation and detection of the significant pushbuttons and it is possible with earlier models to detect the correct permutation by the presence or absence of frictional resistance the permutation push pins.

SUMMARY OF THE INVENTION

In the present invention a slide bar may not be released to move from a position locking a door latch against opening until (1) a proper permutation of push pins is simultaneously moved and manually held from their slide bar blocking position, and (2) after the slide bar is freed from its locking position by knowledgeable indexing of a reset handle control to its concealed neutral position. Any critical push pins not depressed along with any one of improperly depressed push pins prevent movement of the slide bar even if the concealed rotatable member is properly indexed for door opening. All pins are frictionally engaged to mask those which may or may not be frictionally engaged by the latch with a tell-tale frictional contact.

The interference latch engaging elements have limited areas of sliding contact devoid of relative distinguishing frictional movement effects with the relative moving elements in contact with stationary elements, and the latch plate is solely under a substantially constant mild spring-urged resilient pressure to move to its release position as restrained by the permutation pins. A slide plate similar to the latch plate can be used to engage the heads of the non-permutation heads to imitate the feel of the permutation pins moved out of engagement but these still could be a differential "feeling between experimental" movement of the permutation pins and the decoy pins. It is preferred to frictionally contact the shanks of all pins with a spring plate that provides a superior friction under which a heterogeneous number of pins including permutation and decoy pins are effective to misrepresent an experimental combination permutation greater than the mathematical probability of just the number of permutation pins alone, and vary this frictional resiliency by pins that are pressed thereby frictionally varying the spring pressure upon the spring pressed plate decoy latch.

Moreover, the effort of the return springs on each push pin is reasonably high to avert any possible telltale frictional contact differentials between then. Accordingly, until the right permutation of push pins is established and manually held, and the rotational manual reset member is in a proper position, the slide bar is not free to move from its latch sustaining position whether done manually or by spring action.

Moreover, certain push rods should not be pressed because they move into slide bar locking position and their frictional engagement is masked by that of the slide plate. Even with all the proper push pins activated which would permit the bar to move to unlocking position, there is no unlocking movement if any one of several other push rods is improperly pressed. This multiplies the difficulty of an unknown proper permutation being found and actuated for illegal purposes.

The invention is further characterized by a control for releasing the push pins for positive restoration of the latch plate and pins to their locking positions to restore the locking relationship merely by reverse movement of the manual reset member.

IN THE DRAWINGS

FIG. 4 is a back plan view of the embodiment shown in FIGS. 2 and 3;

FIG. 5 is a sectional view taken on line 5—5 in FIG. 4 illustrating inversion of some of the push pins to prevent unlocking if certain wrong pins are actuated or tampered with;

FIG. 6 is a fragmentary view illustrating the interaction between the push pins and the apertured slide bar; and FIG. 7 is an enlarged view of each push pin assembly.

Figure 1:
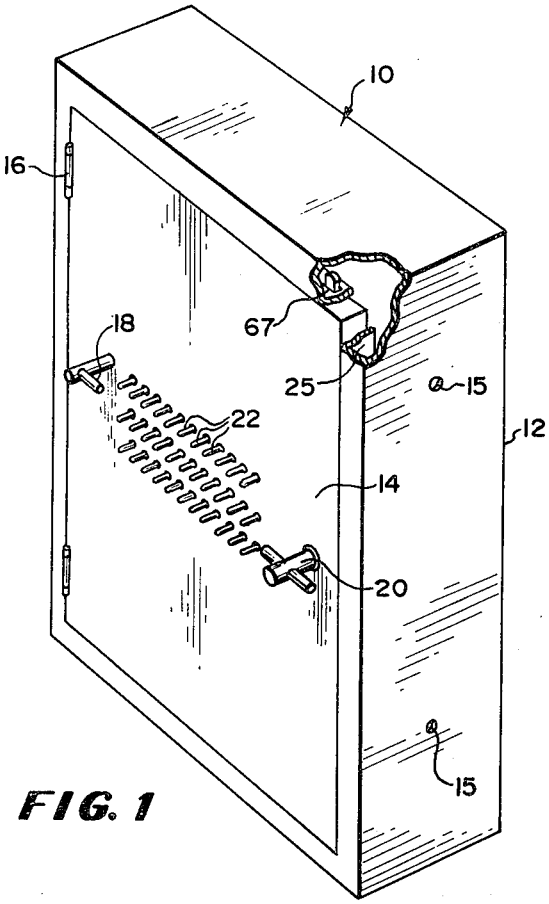
FIG. 1 is a perspective view of a steel wall safe for location between wall studs embodying the invention indicating the relative locations of the manual controls on the door.

Referring to the drawings in further detail, a wall safe 10 for flush mounting in a wall is shown in FIG. 1 having a heavy steel box 12 with a steel door 14 hinged at 16. The box 12 has side openings 15 where it is internally lag-screwed to wall studs through at least two spaced openings 15 which prevents a rocking action to determine their location for destructive removal of the safe. The door is punched out in a master pattern permitting certain permutation lock parts to extend therethrough for manual actuation in opening the door. The parts include two rotatably mounted twist handles 18 and 20 and a plurality of identical push pins 22.

Figure 2:
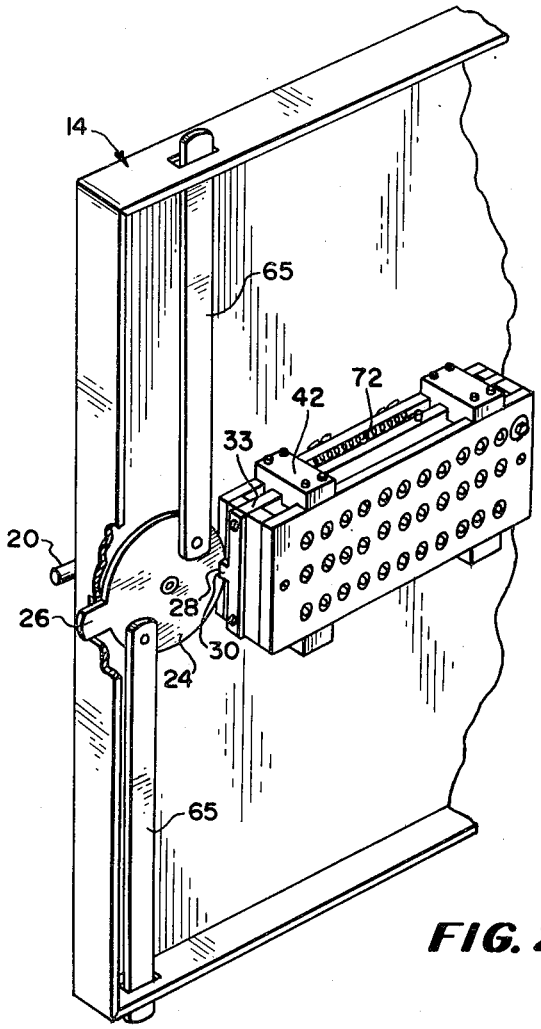
FIG. 2 is a perspective of the door when open showing the mounting of the preferred embodiment of the invention on the back of the door.
Figure 3:
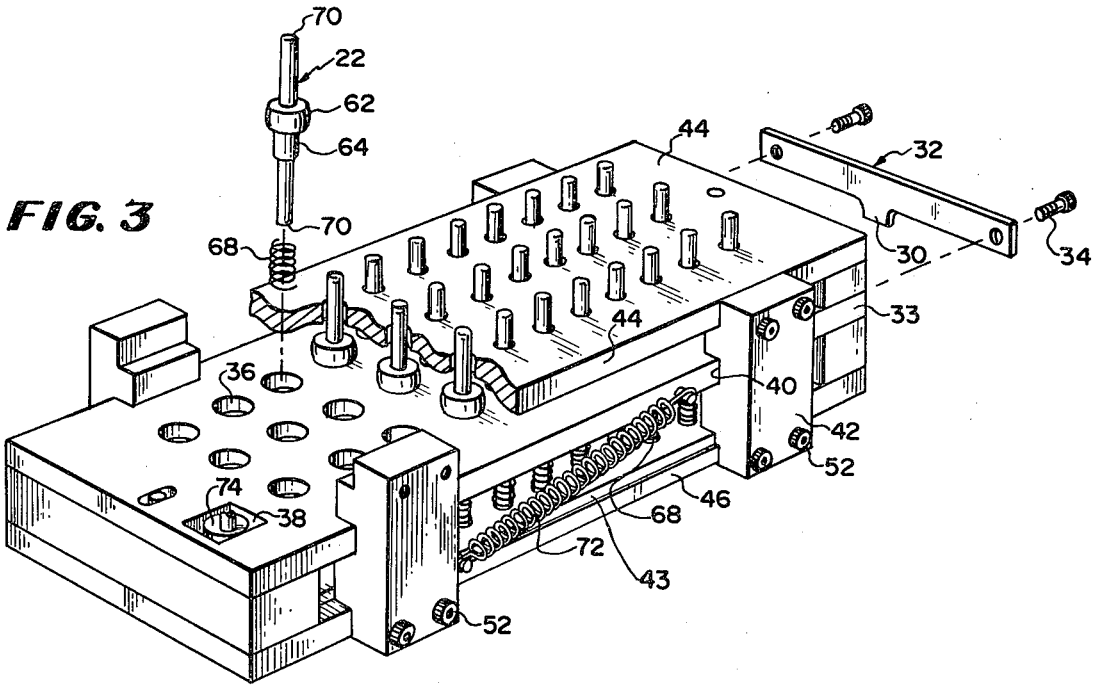
FIG. 3 is an enlarged perspective view, partially in section, illustrating the simple arrangement and assembly of the easily made and assembled elements that provide the permutation.

As shown in FIG. 2, the handle 20 operates a lock plate 24 having a lock element 26 that is rotatable to engage in a cooperating slot (not shown) in a concealed flange 25 of the safe housing 12. Diametrically opposite to the element 26 is a recess 28 in the edge of the plate which receives a retractible locking ear 30 (FIG. 4) which prevents any rotation of the latch element 26 that would open the door. The ear 30 is carried by an end plate 32 secured to a slide bar 33 by screws 34 (FIG. 3).

The slide bar 33 is in the nature of a flat plate having a master pattern of smooth wall openings 36 therethrough arranged over a central area thereof and a cam follower opening 38 adjacent one end. The slide bar 33 is slidably supported in guide notches 40 of spacer members 42 which terminally and laterally support an upper member 44 and a lower member 46 on opposite sides in a relation spaced from the slide bar 33. The upper and lower members 44 and 46 have substantially identical coaxial openings 50 through them arranged in the same pattern as the openings 36 in the slide bar. In the locking position of the slide bar, however, the respective holes 36 and 50 are coaxial (FIG. 5) while in an unlocking orientation (FIG. 6) the axes of the holes 36 in the slide bar 33 are offset with respect to those in the upper and lower members 44, 46 in the direction removing the ear 30 from the recess 28 to permit release movement of the ear 30 for opening the door.

The assembly of the members 44, 46 and the slide bar 33 is maintained as a unit by the spacer members 42 being edge-bolted to the members 44, 46 by bolts 52 as held in spaced relation by spacers 54 and 56 and bolts 58 which can be removed to take off the lower members or back plate 46 for access to invert the push pins 60 which extend through each set of three aligned openings to change the permutation when desired.

As shown in FIG. 7, the push pins 22 are as polished rods, having a large intermediate, preferably circular, member 62 and a member 64 of reduced size adjacent thereto which defines a shoulder 65 approximately equidistant from opposite ends 70 of the rod portion 23 of push pins 22. The larger interface of the intermediate member 62 provides a shoulder 66 that can overlap the sides of openings 36. A compression spring 68 normally abuts the exposed end of the member 64, but as illustrated in FIG. 6, a push pin 22 can be inverted for the spring to rest against the enlargement 62. At the sides of the locking unit, tension springs 72 are provided to engage at one end and urge the slide bar from the position shown in FIG. 5 to that shown in FIG. 6 when it is free to so move for the purpose of offsetting the openings 36 with respect to the axes of the holes 36, and, at its other end the spring 72 engages a friction slide plate 43, as hereinafter described, to imposed diametrically opposing frictional contact pressure up the push pin rods.

The handle 18 is supported on a shaft 73 which drives a cam 74 (FIG. 4) disposed in the follower cavity 38 in the slide bar 33. The cam 74 operates to move the slide bar 33 from the unlocked position shown in FIG. 6 to the locked position shown in FIG. 5. In the latter position the axial alignment of the openings 36 and 50 is established for the location of the push pins 22 in their resting locking positions ready for permutation actuation to unlock and open the safe.

Referring to FIGS. 5 and 6, it will be noted that in both, some of the push pins 22 are oriented differently than others. Pins X are oriented to permit the slide bar 33 to be moved to unlocking position, the bar 33 as shown in FIG. 6 being free to so move, while the actuated push pin Y in FIG. 5 obstructs slide bar movement even though the bar 33 is otherwise free to so move.

In FIG. 5, all the pins except X are in Y orientation and when Y or any other of the Y push pins are pressed, the lock 24 cannot be released. In FIG. 6, the Y pins are not pressed. Accordingly, when X pins are pressed alone, the slide bar 33 is free to move and does so under the influence of tension springs 72 which interconnect the slide plate 43 and the slide bar 33 (FIG. 4).

Preferably, there is more than one pin that is X oriented, preferably five, for the five digits of a person's hand to activate simultaneously, and the high improbability of the combination being detected by experimentation alone as where an unauthorized person is endeavoring to open the safe without tearing it out of the wall.

Accordingly, with springs 72 constructed as long as space in the assembly permits, and with springs 72 only as strong as needed for assured operation of the slide bar, the combination percentage of their working is so small as to be substantially negligible in varying contact slide bar pressures upon push pin heads 62. Furthermore, with both ends of each pin 60 finished alike and substantially bright, it is very difficult to detect from the outside any relative inversions of the push pins 22 as a clue for experimentation in unlocking the wall safe 10.

There may be some pins that lack the full-sized head 62 but preferably all pins are alike and the nonpermutation pins are disposed in the Y orientation so that the mathematical probability of pressing a "single" wrong pin in a four or five correct pin combination is so high as to discourage a person from devoting the necessary time to mathematically solve the combination. On the other hand, there are so many well known different number combinations that any one which is unusual can be selected as the key number while all others which may be known to others have at least one of the numbers in their sequences which could relate to a push pin that is Y oriented. In addition, preferably the pins are not specifically numbered so that the first number in a six or seven oft-remembered numerical sequence can indicate the row where the counting of the sequence pins begins.

In the event, however, random tolerances happen to coincide in a sequence of pin actuations which inadvertently lead to only the effective pins being selected, the relative pin orientation relationship can be changed by changing the pattern of push pin inversions. However, the mathematical probability of such occurring is so slight that it would be extremely rare. Otherwise, if there is an individual contact at only one head 62 under resting conditions, it must be first detected, and then most likely subsequent contacts will be difficult to isolate among all of the push pins.

Moreover, the handle 18 controlling the cam 74 must be set in correct position to fully release any restraint upon the slide bar movement, and in this relation there is no change in the "feel" of the cam 74 engagement except at possibly one exact point: the locked position. This is a further mental burden on an unauthorized solution to opening the safe unless the correct combination happens to be first attained without the cam being in the slide bar resetting locked position.

With the proper permutation of the push pins 22 pressed, the latch ear 30 is drawn to the position indicated in FIG. 6 and the disk 24 is free to be operated by the handle 20 to retract the latch ear 26 and the lock bars 65 from slots 67 on the door frame 25 and thereby to unlock the door 14 for opening. Once open, the slide bar 33 is in retracted position, is held there by the disk 24 and in turn the slide bar holds the push pins 22 in their depressed positions until the door is again closed. Thereupon, the disk is turned back, releasing the slide bar tab 30 for it to enter recess 28 again and permit the push pins to be restored to their original positions by their springs 68.

In order to minimize if not eliminate any differential tactual feel of the operation of each pin in an endeavor to detect the critical ones, the heads 62 preferably have a spherical curvature contour on them having a radius approaching the length of the pin. The curvature indicated in the drawings being illustrated is exaggerated for recognition, and although it may be usable, such could be a little too distinctive in sensing contact movement with the wall of any opening 36 if the tolerances which that pin may have makes sole contact for holding the slide bar primarily in locked position.

Also a friction plate 43 having holes 45 coaxial with the holes 36 and 50 is slidably mounted against the inner face of the lower member 46 for relating sliding movement thereon to frictionally engage against the push pin shafts under the effort of the springs 68 and with the other end of the springs 72 attached thereto to provide a scissoring frictional effect between the plate 43 and member 46 against the shafts of the pins 22 manually reciprocable with respect thereto. In this connection the springs 68 are sufficiently heavy to veil a possible detectible variation in the frictional slide of the contact if that particular contact is the sole primary contact with the wall of an opening 36. A gradual relinquishment of contact by the most gradual curvature possible within appropriate manufacturing tolerances would be very difficult to detect. If there is any discrepancy of clearances, the curvature should be such that the heads 62 will cam in and out of the openings 36.

Moreover, upon reset, such cannot be accomplished accidentally when closing the door since the lock bars 65 and ear 26 must be intentionally reset in locking position unless the handle locates the elements 28 and 30 in coincidence, which in turn does not accomplish a relock until the handle 18 positively moves the slide bar against the tension of the springs 72 to provide coaxial relationship of the openings which permits the permutated push pins to recover their slide bar locking positions. Thus, there is no unyielding blocking of the push pins when moved manually and no unyielding positive drive linkage to force the slide bar to open, only a resilient movement when the slide bar is freed for movement.

In view of this lack of possible undue strain, the pin supporting parts can be made of molded plastic with mirror finish surfaces that provide minimum friction for relative movements, the shanks of the pins 22, the cam 74, and interlocking members 24,30 being made of high shear strength material such as steel.

Also, it may be noted that the members 62,64 can be made of a high impact plastic, leaving the rod of uniform diameter to prevent any possible differential resistance paths or distance of magnetic flux concentrations being detected among the pins in their permutated positions.

Thus, a very compact wall safe lock that is light and strong is provided for recess installation in a wall between wall studs and provides a simple highly foolproof permutation lock which can be unlocked with one hand operating the permutation of the pins and opened by the other hand by first rotating a hidden cam 38 to a known but unmarked position to release the slide bar and then resiliently unlatch the lock for opening the safe door manually. However, sequentially one hand can be used to move the cam first into exact position to clear the slide bar, then one or two hands can permutate the pins pressed for the springs 72 to clear the lock 24 for opening. In fact, if it is desired that two people be present at each opening, the hidden cam can be moved to release position and three or more be required to actuate the permutation. Once the permutation is actuated the safe is ready to open.

What is claimed is:

1. A permutation wall safe lock having a set of small openings in the front wall of a safe door arranged in a predetermined pattern;

a guide member having a set of like small openings arranged in said predetermined pattern and providing therewith pairs of coaxially aligned openings;

a plate member slidably mounted on the guide member having like small openings coaxial with said set of openings;

resilient means engaging the plate member for urging its like small opening out of alignment with said set of openings;

means for supporting said front wall and guide member in predetermined spaced relation;

a manually operated door lock means including an oscillatable manually movable locking member mounted on said door;

a reciprocable slide bar means having large openings of the same shape as the small openings arranged in the same predetermined pattern and slidable in the spaces between the front wall and said guide member, said slide bar means being movable between two positions in one of which it is releasably interlocked with said manually movable locking member with its openings coaxial with said pairs of openings and in the other unlocked position its openings are held offset from said pairs of openings;

a plurality of freely reciprocable push pins slidably extending through said aligned openings for independent selective manual actuation and having large portions receivable in the large openings for normally inter-engaging in said one position the walls of said pairs of openings and said large openings to maintain said axial alignments and the slide bar in interlocking relationship with said manually movable locking member;

manual means for moving said slide bar means to said other position to dispose said slide bar means in locking engagement with said manually movable locking member; and said resilient means urging said slide bar means out of engagement with said manually movable locking member when correctly permutated push pins are axially moved in said small openings to clear said slide bar openings for movement of the slide bar to said other position.

2. The combination called for in claim 1 in which said permutated push pins have different sized portions engaged by the walls of the openings of said slide bar means.

3. The combination called for in claim 1 in which some of the push pins have enlarged portions engaging the walls of the openings of said slide bar when depressed to hold the slide bar against lock release movement.

4. The combination called for in claim 1 in which the push pins have an enlarged portion received in the openings in said slide bar to hold the slide bar against unlocking movement alternately with reduced portions received in the openings which permit the slide bar to move to an unlocking position when the permutation of push pins is established.

5. The combination called for in claim 1 in which said resilient means, plate member and guide member impose opposing frictional forces upon movement of said push pins at said axially aligned small openings of said guide member, plate member and front wall.

6. A manually operable permutation wall safe lock construction having a set of small openings through a front wall of the safe door arranged in a predetermined pattern and coaxially aligned in pairs therewith a set of like small openings in a rear wall of the safe door spaced from the front wall;

interlockable and retractable lock elements defining a like cross-sectional configuration and each movable with respect to the other for locking and unlocking the door;

a manually movable member mounted on said door carrying one of said lock elements for moving it from an unlocked position to its locked position;

a reciprocable slide bar carrying the other of said elements for moving it from its locked position to its unlocked position and having openings of a configuration like said small openings and arranged in the same predetermined pattern, said slide bar being movable between its two positions in one of which said slide bar openings are coaxial with said aligned pairs and in the other position of which its openings are offset with respect to said aligned pairs of openings;

a plurality of permutation push pins having opposite end positions of like outward appearance slidably extending through the pairs of aligned small openings and said slide bar openings for independent selective manual actuation and normally interengaging the walls of said coaxially aligned openings to maintain said axial alignments and hold the elements in locking relationship:

manual means for moving said slide bar to said one position for locking engagement with said manually movable member;

slide plate means for frictionally engaging the sides of one of the end positions of each one of the push pins adjacent one of said walls; and resilient means interconnecting said slide bar and slide plate means urging said slide plate means and slide bar radially in opposite directions to impose friction laterally upon the push pins while urging said slide bar to its opening offset position when the permutation of push pins is axially established in appropriate small openings to clear said slide bar openings for movement of the slide bar to said offset position.

7. The safe lock defined in claim 6 in which said push pin assemblies comprise large and small elements spaced on a push rod of uniform cross-sectional shape and dimension and defining remote shoulders, and resilient means on said push rod engaging one of the shoulders and said slide bar.

* * * * *